US008414671B2

(12) United States Patent
Augustine et al.

(10) Patent No.: US 8,414,671 B2
(45) Date of Patent: Apr. 9, 2013

(54) PERSONAL AIR FILTRATION DEVICE FOR USE WITH BEDDING STRUCTURE

(75) Inventors: Scott D. Augustine, Bloomington, MN (US); Mark C. Albrecht, Minneapolis, MN (US); Joshua P. Waldman, Edina, MN (US); Randall C. Arnold, Minnetonka, MN (US)

(73) Assignee: Augustine Biomedical and Design, LLC, Eden Prairie, MN (US)

( * ) Notice: Subject to any disclaimer, the term of this patent is extended or adjusted under 35 U.S.C. 154(b) by 157 days.

(21) Appl. No.: 12/574,539

(22) Filed: Oct. 6, 2009

(65) Prior Publication Data

US 2010/0101418 A1 Apr. 29, 2010

Related U.S. Application Data

(60) Provisional application No. 61/103,235, filed on Oct. 6, 2008.

(51) Int. Cl.
*A47G 9/00* (2006.01)
*A62B 7/00* (2006.01)

(52) U.S. Cl.
USPC .. 55/385.2; 55/467; 55/DIG. 29; 128/205.12; 128/205.27; 128/205.29

(58) Field of Classification Search ..... 55/385.1, 55/385.2, 467, 563, 471, 473, DIG. 39; 454/187, 454/188, 189; 128/205.12, 205.27, 205.29; 600/22

See application file for complete search history.

(56) References Cited

U.S. PATENT DOCUMENTS

| | | | | |
|---|---|---|---|---|
| 96,989 | A | | 11/1869 | Somes |
| 2,025,659 | A | | 12/1935 | Gilquin |
| 3,266,064 | A | | 8/1966 | Figman |
| 3,653,083 | A | | 4/1972 | Lapidus |
| 3,724,172 | A | * | 4/1973 | Wood ..... 95/287 |
| 3,820,536 | A | * | 6/1974 | Anspach, Jr. et al. .... 128/202.13 |
| 3,941,697 | A | | 3/1976 | Johnson |
| 4,391,009 | A | | 7/1983 | Schild |

(Continued)

FOREIGN PATENT DOCUMENTS

| | | |
|---|---|---|
| EP | 0624340 | 11/2011 |
| JP | 2005111048 | 4/2005 |
| WO | 9711625 | 4/1997 |
| WO | 2005027699 | 3/2005 |

OTHER PUBLICATIONS

Avidan et al., "Convection Warmers, Not Just Hot Air", Anaesthesia, 1997, pp. 1073-1076, 52, Blackwell Science Ltd.

PCT/US2009/036260, Invitation to Pay Additional Fees and Partial International Search Report, dated Jul. 10, 2009.

(Continued)

*Primary Examiner* — Duane Smith
*Assistant Examiner* — Minh-Chau Pham
(74) *Attorney, Agent, or Firm* — Fredrikson & Byron, PA

(57) ABSTRACT

Devices, methods and systems for creating a zone of filtered air proximate a head of a user including an air filtration device including a blower being configured to be disposed within, below, or affixed to a bedding structure, an air plenum in flow communication with the blower and in support of the head of the user and having an air delivery surface configured to distribute the air flow to the zone of filtered air, and a filter disposed within the device for filtering the air flow before it is distributed to the zone of filtered air.

20 Claims, 14 Drawing Sheets

U.S. PATENT DOCUMENTS

| | | | | |
|---|---|---|---|---|
| 4,398,535 | A | 8/1983 | Guibert | |
| 4,818,122 | A | 4/1989 | Arbuthnot | |
| 4,977,634 | A | 12/1990 | Koji | |
| 5,160,517 | A | 11/1992 | Hicks | |
| 5,247,714 | A | 9/1993 | Lipps | |
| 5,304,213 | A | 4/1994 | Berke | |
| 5,305,483 | A | 4/1994 | Watkins | |
| 5,312,465 | A | 5/1994 | Riutta | |
| 5,317,767 | A | 6/1994 | Hargest | |
| 5,389,037 | A | 2/1995 | Hale | |
| 5,588,698 | A | 12/1996 | Hsueh | |
| 5,733,320 | A | 3/1998 | Augustine | |
| 5,785,723 | A | 7/1998 | Beran | |
| 5,876,428 | A | 3/1999 | Van Duren | |
| 5,902,365 | A | 5/1999 | Haggard | |
| 6,230,350 | B1 | 5/2001 | Goldstein | |
| 6,261,332 | B1 | 7/2001 | Richard | |
| 6,440,157 | B1 | 8/2002 | Shigezawa | |
| 6,447,538 | B1 | 9/2002 | Van Duren | |
| 6,702,662 | B2 * | 3/2004 | Kristensson | 454/187 |
| 6,988,293 | B2 | 1/2006 | Ritter | |
| 7,037,068 | B2 | 5/2006 | Cobb | |
| 7,037,188 | B2 | 5/2006 | Schmid | |
| 7,063,087 | B2 | 6/2006 | Cerbini | |
| 7,118,608 | B2 | 10/2006 | Lovell | |
| 7,195,660 | B2 * | 3/2007 | Little et al. | 55/385.1 |
| 7,279,021 | B2 | 10/2007 | Haberlein | |
| 7,370,380 | B2 | 5/2008 | DeFranks | |
| 7,607,433 | B2 | 10/2009 | Silva | |
| 2003/0033790 | A1 * | 2/2003 | Hague | 55/385.1 |
| 2003/0036786 | A1 | 2/2003 | Duren | |
| 2003/0084510 | A1 | 5/2003 | Lin | |
| 2003/0089233 | A1 | 5/2003 | Borla | |
| 2003/0150328 | A1 * | 8/2003 | Hansson et al. | 95/273 |
| 2004/0112381 | A1 | 6/2004 | Ujhazy | |
| 2004/0244595 | A1 | 12/2004 | Elliot | |
| 2005/0229557 | A1 | 10/2005 | Little | |
| 2006/0271134 | A1 | 11/2006 | Frey | |
| 2007/0240719 | A1 | 10/2007 | Duarte | |
| 2008/0020695 | A1 * | 1/2008 | Chang | 454/56 |

OTHER PUBLICATIONS

PCT Application No. PCT/US2008/054928, International Search Report and Written Opinion, dated Jul. 11, 2008, 10 pages.

International Search Report and Written Opinion, dated Nov. 17, 2009 for PCT Application No. PCT/US2009/059721, 7 pages.

* cited by examiner

PERSONAL AIR FILTRATION DEVICE FOR USE WITH BEDDING STRUCTURE

PRIOR APPLICATION

The present application claims priority to provisional patent application No. 61/103,235 and includes most of the disclosure of pending utility patent application Ser. No. 12/037,078, entitled PERSONAL AIR FILTRATION DEVICE filed on Feb. 25, 2008, the disclosures of which are hereby incorporated by reference in their entirety.

TECHNICAL FIELD

The present invention is related to air filtration devices. In particular the invention relates to air filtration devices to provide directed filtered air to a sleeping or resting person.

BACKGROUND

It is estimated that 1 in 5 Americans suffer from allergic rhinitis/conjunctivitis (AR). AR is the result of an IgE mediated immune system response to inhaled aero-allergens, which typically include dust mite, fungi, animal dander, pollutants, molds, and pollens. For those individuals afflicted by AR, the short term effects extend beyond the physical symptoms found in the eyes and nose, often resulting in cognitive impairment, sleep disturbance, lowered work/school productivity, and reductions in quality of life. More alarmingly, if AR symptoms persist on a long term basis the disease can lead to the development of comorbities, including asthma, sinusitis, otitis media, nasal polyposis, lower respiratory tract infection, and dental malocclusion.

Typical treatment for AR consists of three steps. First, the trigger allergen(s) is identified and environmental control measures are employed to minimize allergen exposure. Second, if elimination steps are unsuccessful, medication is employed to manage and control symptoms. Third, for perennial allergen exposure, immunotherapy may be undertaken to obtain long term symptom control. Allergen avoidance is the preferred treatment, providing symptom resolution absent medication. But to date few allergen avoidance measures exist that reduce airborne allergen concentrations to a clinically relevant level.

Effective allergen avoidance focuses on two basic principles: identification of the offending allergen source, and removal/elimination of the offending source or reduction of the concentration of inhaled aero-allergens. Commonly practiced allergen avoidance measures that are clinically effective include pet removal from the home and geographic re-location. Other forms of allergen avoidance that are of questionable clinical effectiveness but are commonly practiced include whole room air filtration, dust mite casings, use of air conditioning, and carpet removal.

Of the listed allergen avoidance measures, air filtration systems, some of which remove particulates at 99.97% efficiency, show great promise for reducing inhaled aero-allergen concentrations to a clinically relevant level. However, the current practice of such technologies limit their effectiveness. For example, people often utilize room air cleaner units in an attempt to achieve a reduction in particle levels within a localized area. These types of units effectively remove a high percentage of harmful particles from the air that flows through the unit. However, individuals within the area of the unit may not experience all of the beneficial results of this particle removal because the air that is discharged from the unit is able to pick up additional harmful particles from the surrounding environment prior to reaching and being breathed in by the individuals. Furthermore, the effectiveness of air cleaners and purifiers is greatly affected by the size of the room, such that results worsen as the room size increases. Other room factors such as air-tightness, the presence of air currents and traffic which can kick up particles, also affect the performance of air cleaners and purifiers. In the case of dust mites residing in bedding, a room air filter can not adequately reduce the allergenic exposure between the bedding and the person sleeping in the bed. Given these factors, it is difficult for an air cleaner or purifier to significantly reduce the levels of allergens and pollutants being breathed by an individual.

Prior art air cleaners have attempted to reduce these problems by directing air directly into the face of a sleeping person. Such devices must blow a considerable wind on to the sleeping person's head in order to prevent ambient particles from circulating near the person while sleeping. Such high wind levels may be annoying to a person who is trying to sleep. Furthermore, many of these devices are cumbersome, expensive and unsightly.

SUMMARY

Embodiments of the invention include methods, devices, and systems for creating a zone of filtered air proximate a head of a user. In some embodiments, the system includes an air filtration device including a blower, an air plenum and a filter. In some embodiments, the blower is configured to provide an air flow and is configured to be disposed within, below, or affixed to a bedding structure. In some embodiments, the air plenum is in flow communication with the blower, supports the head of the user and has an air delivery surface configured to distribute the air flow to the zone of filtered air. In some embodiments, the filter is disposed within the device and filters the air flow before it is distributed to the zone of filtered air.

In some embodiments, the system for creating a zone of filtered air proximate a head of a user includes an air filtration device including a blower configured to provide an air flow, the blower configured to be disposed within, beneath, or affixed to a bedding structure, a head support including an air plenum and a sleeve, and a filter disposed within the air filtration device for filtering air flow before it is distributed to the zone of filtered air. In some embodiments, the sleeve is attachable to the blower and the air plenum is in flow communication with the blower through the sleeve. In some embodiments, the air plenum has an air delivery surface configured to distribute the air flow to the zone of filtered air.

In some embodiments, the system further includes a bedding structure, which may include a mattress and may also include a foundation. The bedding structure may include a blower cavity and the blower may be located within the blower cavity. The system may further include air ducting providing flow communication between the blower and the air plenum or head support, the air ducting passing through or around the bedding. In some embodiments, the bedding structure also includes one or more channels, and the ducting may be located within these channels. In some embodiments, the system includes two air plenums or head supports and two user attachment points for connecting the ducting to each of the plenums or head supports. In such embodiments, airflow through either of the user attachment points may be blocked by the user.

In some embodiments, the air plenum includes a sleeve which is detachably attached to the blower. In some of these embodiments, the filter may be located within the sleeve.

In some embodiments, the blower may include brackets for mounting the blower to the side of the bedding structure.

In some embodiments, the head support includes an upper surface which forms an upper surface of the plenum. In some embodiments, the head support includes a pillow pocket beneath the plenum. In some embodiments, the head support includes a plenum pocket into which the plenum is inserted.

Embodiments of the invention include a method of creating a zone of filtered air proximate a head of a user including providing a bedding structure, providing an air filtration device including a blower, an air plenum and a filter, and activating the blower to deliver filtered air to the user. In some embodiments, the bedding structure includes a mattress and/or a foundation. In some embodiments, the blower is configured to provide an air flow and is disposed within, beneath or affixed to a side of the bedding structure. In some embodiments, the air plenum is in flow communication with the blower and in support of the head of the user, has an air delivery surface configured to distribute the air flow to the zone of filtered air and may be located at a head end of the bedding structure. In some embodiments, the filter is provided by in the air filtration device and filters the air flow before it is distributed to the zone of filtered air. In some embodiments, the plenum is connected to the blower by a sleeve and the filter is provided within the sleeve.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION

Figure 1:
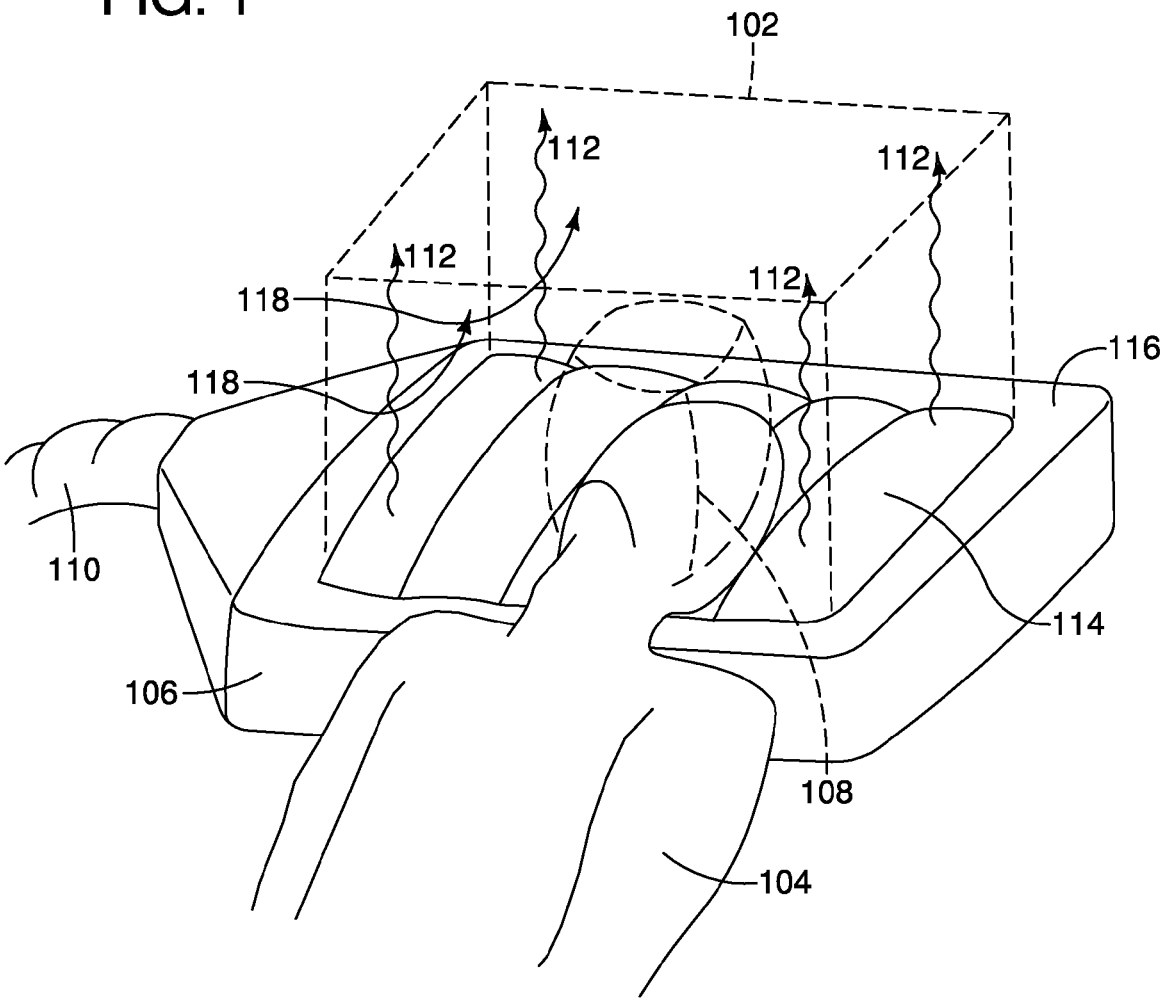
FIG. 1 is a perspective view of a personal air filtration device in use according to some embodiments.

The following discussion is presented to enable a person skilled in the art to make and use the invention. Various modifications to the illustrated embodiments will be readily apparent to those skilled in the art, and the generic principles herein may be applied to other embodiments and applications without departing from the spirit and scope of the present invention as defined by the appended claims. Thus, the present invention is not intended to be limited to the embodiments shown, but is to be accorded the widest scope consistent with the principles and features disclosed herein. The following detailed description is to be read with reference to the figures, in which in some figures like elements have like reference numerals. The figures, which are not necessarily to scale, depict selected embodiments and are not intended to limit the scope of the invention. Skilled artisans will recognize the examples provided herein have many useful alternatives which fall within the scope of the invention. Examples of constructions, materials, dimensions, and manufacturing processes are provided for selected elements, and all other elements employ that which is known to those of skill in the field of the invention. Those skilled in the art will recognize that many of the examples provided have suitable alternatives that can be utilized.

The device, systems and methods of the invention provide a flow of filtered air to a breathing zone of a person without blowing a high volume of air toward the person's face. Embodiments of the invention include a head support which can be positioned beneath a user lying on a bed. The head of the user rests on top of a head support, through which the air is delivered. Air is supplied to the head support through ducting connected to a blower located within or beneath a bed, such as within the mattress and/or the mattress foundation, such as the box spring. The mattress and/or foundation may include channels through which the ducting passes to the head support, and/or through which ambient air may be supplied to the blower. Alternatively, the blower may be attached to or affixed to or supported by the side of the bed and the bed may not have channels. A filter is located within the air filtration device, such as within the blower, the head support, or the ducting, such that filtered air is supplied through the head support to the user, directly to a space around the user's head or breathing zone. In this way, filtered air can be delivered without the need to filter the air of the entire room, making filtration more efficient and effective. By decreasing the amount of time and distance between the release of air from the device and inhalation by the user, the amount of recontamination of the filtered air is decreased. In addition, the continuous flow of filtered air into the breathing zone prevents unfiltered, contaminated air from the environment from entering the breathing zone due to inhalation by the user or current flow within the environment. Moreover, the zone of filtered air can be maintained at a low flow rate, reducing unwanted noise and the feeling of wind blowing on the sleeping person's face. By locating the blower within the bedding structure or beneath the bedding structure, the noise of the blower is further reduced, and no space is lost to the blower, which remains out of sight.

The head support includes an inflatable air plenum. As air flows into the head support, it accumulates within the plenum causing it to inflate. The plenum includes an air permeable portion through which the filtered air exits the head support to be supplied the breathing zone of the user. Such an arrangement can provide an efficient, effective delivery of filtered air to the breathing zone of the user.

FIG. 1 illustrates how an embodiment of a personal air filtration device 100 can be used to provide a volume or bubble of filtered air 102 to a user 104. The user 104 is shown lying upon head support 106 with dotted lines depicting the breathing zone 108 of the user 104. The breathing zone 108 is a volume of air proximate the user 104 and available for inspiration. Generally the breathing zone is located proximate the user's head, and more specifically proximate the mouth and of nose of the user. The size of the breathing zone 108 can vary depending upon the user's lung capacity, depth of breathing, breathing rate, and other factors. In many adults, the breathing zone 108 can represent a volume of approximately 1-10 liters of air, however smaller or larger volumes are contemplated. When breathing, a user 104 draws air from the breathing zone 108 and into his or her lungs. Therefore, by ensuring that the breathing zone 108 includes only filtered air, one can be sure that the user inhales only filtered air.

Embodiments of the invention provide filtered air to the breathing zone 108 by creating a bubble of filtered air 102 to encapsulate the user's breathing zone 108. In operation, a blower (not shown) can provide a flow of air to the head support 106 through a hose 110, for example. The head support 106 disperses the air and provides a filtered air flow 112 through an air permeable portion 114 of its upper surface 116. This filtered air flow 112 provides a supply of filtered air to the bubble 102 and prevents unfiltered environmental air from reaching the breathing zone 108. As the user 104 breathes, air is inhaled, and thereby displaced from the breathing zone 108. This displaced breathing zone air is then replaced with filtered air from the bubble 102, to the exclusion of unfiltered environmental air.

Moreover, the filtered air flow 112 can prevent currents of unfiltered environmental air 118 from penetrating the breathing zone 108. Disturbances in the environment (such as, for example, moving people, animals, or fans) or inhalation from a user 104 can cause unfiltered environmental air (i.e. air outside of the bubble 102) to move and form currents. Such currents 118 could penetrate the breathing zone 108 and be inhaled, mitigating the benefits of providing filtered air to the user. However, the continuous, laminar filtered air flow 112 provided by embodiments of the invention can act like a curtain, sweeping these currents 118 away from and out of the breathing zone 108 (as illustrated by the curved portion of arrows 118 in FIG. 1). As such, the bubble 102, can provide a reservoir of filtered air to user for inspiration. In some embodiments, the bubble 102 can be defined as a volume of air having a particle count less than 100,000 particles 0.3 micrometers (μm) or greater in diameter per cubic foot. Or the bubble 102 may be defined terms relative to the ambient particulate concentration, e.g. a volume having particle count at less than 50% of that of the surrounding environment. Further, in many embodiments, the bubble 102 created by the device is at least as large as the breathing zone 108 of the user and positioned such that the breathing zone 108 is positioned entirely within the bubble 102. Preferably, the bubble 102 is at least twice the size of the breathing zone 108. And while the embodiments discussed above have defined a bubble 102 as being positioned about or around a user's head, one should recognize that other arrangements, such as creating a bubble 102 off to one side of a user's head, are contemplated.

Embodiments of the inventions are used with bedding structures. Such bedding structures typically include a mattress. The mattresses may be spring mattresses, foam mattresses, or any other material or combination of materials. Some bedding structures include only a mattress, while others also include a foundation upon and above which the mattress rests. Examples of foundations include box springs, platforms, bed frame, and other supports.

Figure 2:
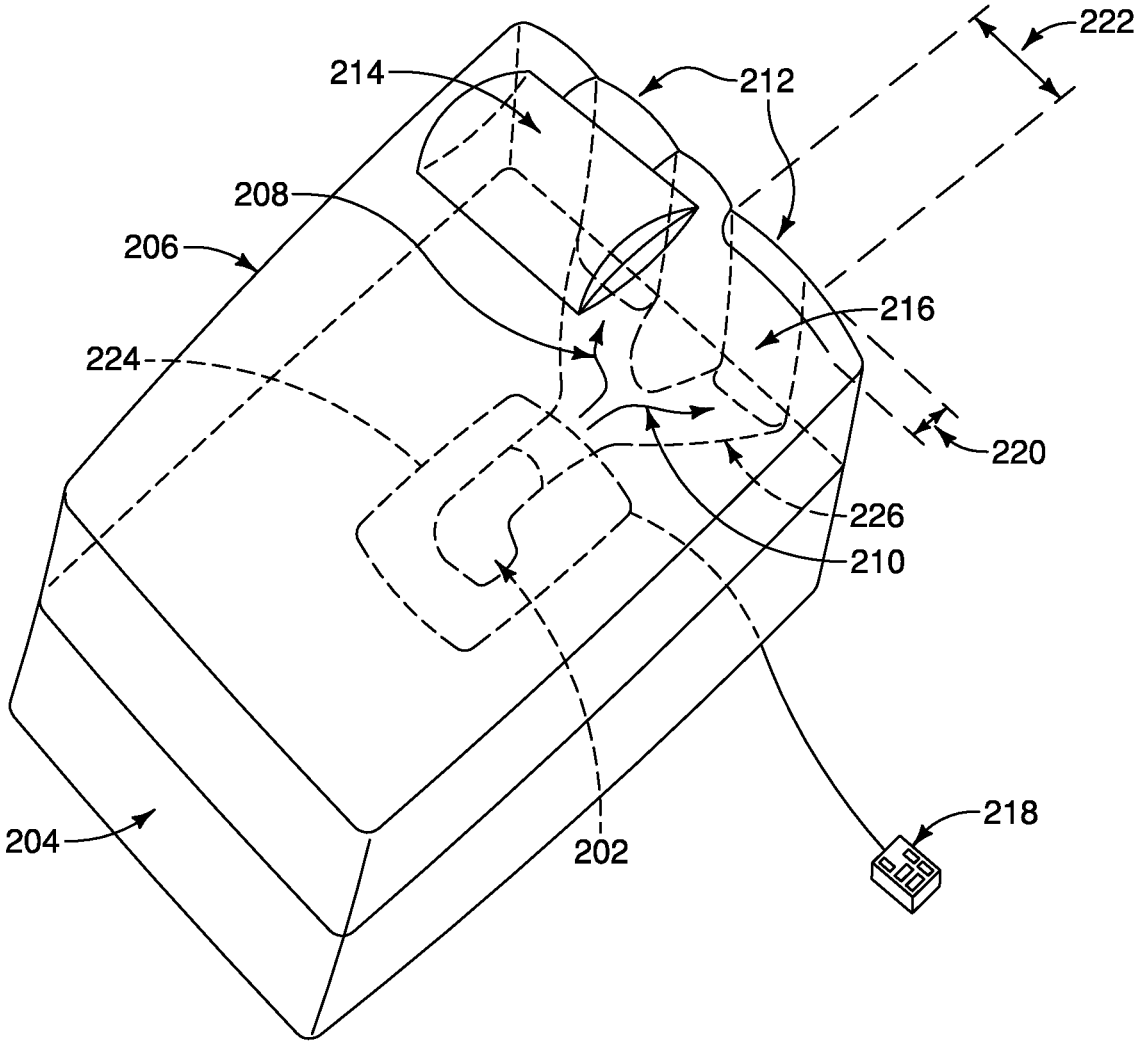
FIG. 2 is an upper perspective view of a personal air filtration system according to embodiments of the invention.

An air filtration system according to embodiments of the invention is shown in FIG. 2. In this embodiment, the air filtration system may be used to supply filtered air to either one or two users. In this embodiment, a blower 202 is located within a mattress foundation 204 in a blower cavity 224 or blower space. The blower cavity 224 is a hollow or empty space which contains the blower 202. The blower cavity 224 is sized to accommodate and support the blower 202. In the embodiment shown, the blower cavity 224 is entirely within the foundation 204, and includes a bottom surface, an upper or top surface, and one or more side walls (usually four to accommodate a rectangular blower 202, though more or less could be used). The upper surface or top of the blower cavity, or a portion thereof, may be removable to allow access to the blower 202. Alternatively, the blower cavity 224 may have no top, or may have only a partial top, to allow access to the blower 224 simply by removing the mattress 202 from above the blower cavity 224. In still other embodiments, the blower cavity 224 may be located adjacent to or abutting one or more sides of the mattress 206 or foundation 204 in which it is contained, such as the head end 228 or in a corner 230 of the mattress 206 and/or foundation 204. In such embodiments, the blower cavity would include a bottom surface and one or more side walls, but would be exposed on one or more sides to allow access to the blower 202. Furthermore, such embodiments may not require the use of horizontal outflow channels for the passage of the ducting 210 from the blower 224 to the head support, or inflow channels for the supply of ambient air to the blower 202.

Providing the blower 202 within a blower cavity 224 in the mattress 206 and/or foundation 204 provides several advantages. Not only does it conceal the blower 202 from the user's sight, but it also reduces the blower noise reaching the user by utilizing the noise dampening properties of the mattress 206 and foundation 204. A remote control 218 may be provided for the user to control the blower's operation.

Figure 5:
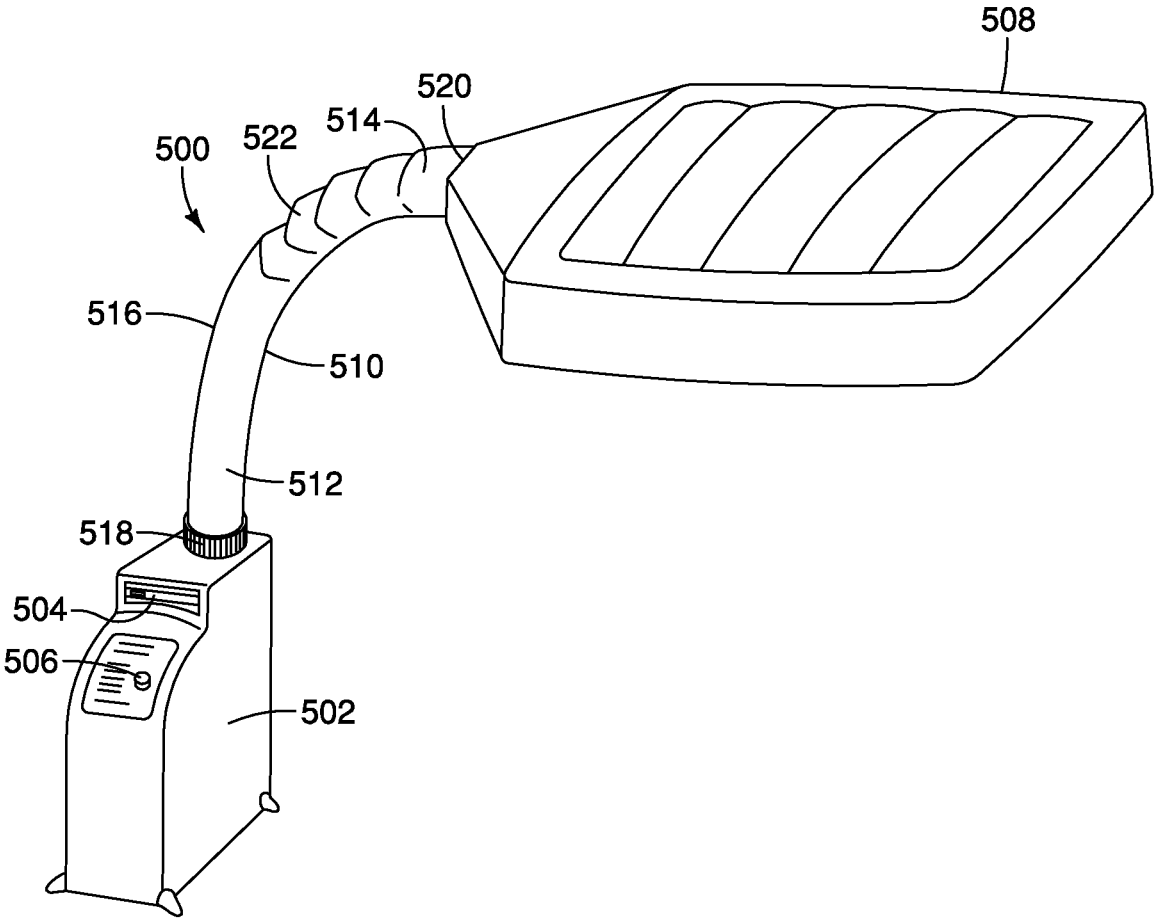
FIG. 5 is a perspective view of a personal air filtration device according to embodiments of the invention.

In operation, the blower 202 receives ambient air through an air intake port (see 504, FIG. 5). The air input may include inflow ducting connected to the blower 802 which connects the blower 202 to the ambient air somewhere around the bed through inflow channels in the bedding structure such as in the mattress 206 and/or in the foundation 204. Alternatively, if the blower cavity 224 is located adjacent to and open to a side of the bed, or has an opening in the bottom surface of the blower cavity connecting to the space beneath the bed, no inflow ducting or inflow channels may be required such that air may flow directly to the air inlet of the blower 202, which is oriented toward the opening or exposed side of the blower cavity 224. In addition, the inflow ducting or the air inlet of the blower 202, may include an optional filter to pre-filter the air prior to reaching the blower 202, particularly in embodiments where ambient air is obtained from beneath the bed, where dust levels may be higher.

The blower 202 pressurizes ambient air and provides an air flow 208 to outflow ducting 210 which passes through a horizontally oriented channel 226 or tunnel within the mattress 206 and/or foundation 204. The outflow ducting 210 and channel 226 splits into a Y shape to optionally provide airflow to two users. Alternatively, the ducting may pass beneath the foundation 204 without the need for a horizontal channel 226. To reach the top surface of the mattress 206, the ducting may bend upward, such as through an approximately 90 degree of L shaped bend at the head end 228 of the bedding structure. As shown in FIG. 2, the ducting 210 bends upward, passing through vertically oriented outflow channels 216 cut into the mattress 206 at the head end 228. Alternatively, in some embodiments in which the horizontal channels may extend to a side of the bedding structure and the vertically oriented outflow channels may be provided on the side of the mattress 206 and optionally the foundation 204. These vertical outflow channels 216 may also be cut into the foundation 204, such as in embodiments in which the outflow ducting 210 passes beneath the foundation 204 with out the use of a horizontal outflow channel 226. In some embodiments, the dimensions of the vertical outflow channels 216 range from 2 to 0.25 inches in depth 220 and 15 to 5 inches in width 222 to permit adequate cross sectional area for passage of the airflow. Accordingly, the vertical outflow channel 216 represents only one of many channel shapes that would allow the passage of the outflow ducting 810 to the top surface of the mattress 806. In some embodiments, a single horizontal channel may be used for both the inflow and outflow ducting, with both ducting passing together through the horizontal channel.

The outflow ducting 210 extends vertically to reach the top surface of the mattress where it connects to the head support 214, such as at connection points 212. In the embodiment shown in FIG. 2, there are two user connection points 212. The user connection points 212 couple the head support 214 to the outflow ducting 210 to receive the airflow from the blower. In this way, air flow is directed to the one or more user(s) by passing through the head support 214 and air plenum. When only one user uses the air flow system, the air flow to the second user connection port may be blocked, such as by use of a draw string or zipper or other closure mechanism which may be located at the proximal end of the ducting, such as at the user attachment point 212.

Figure 3:
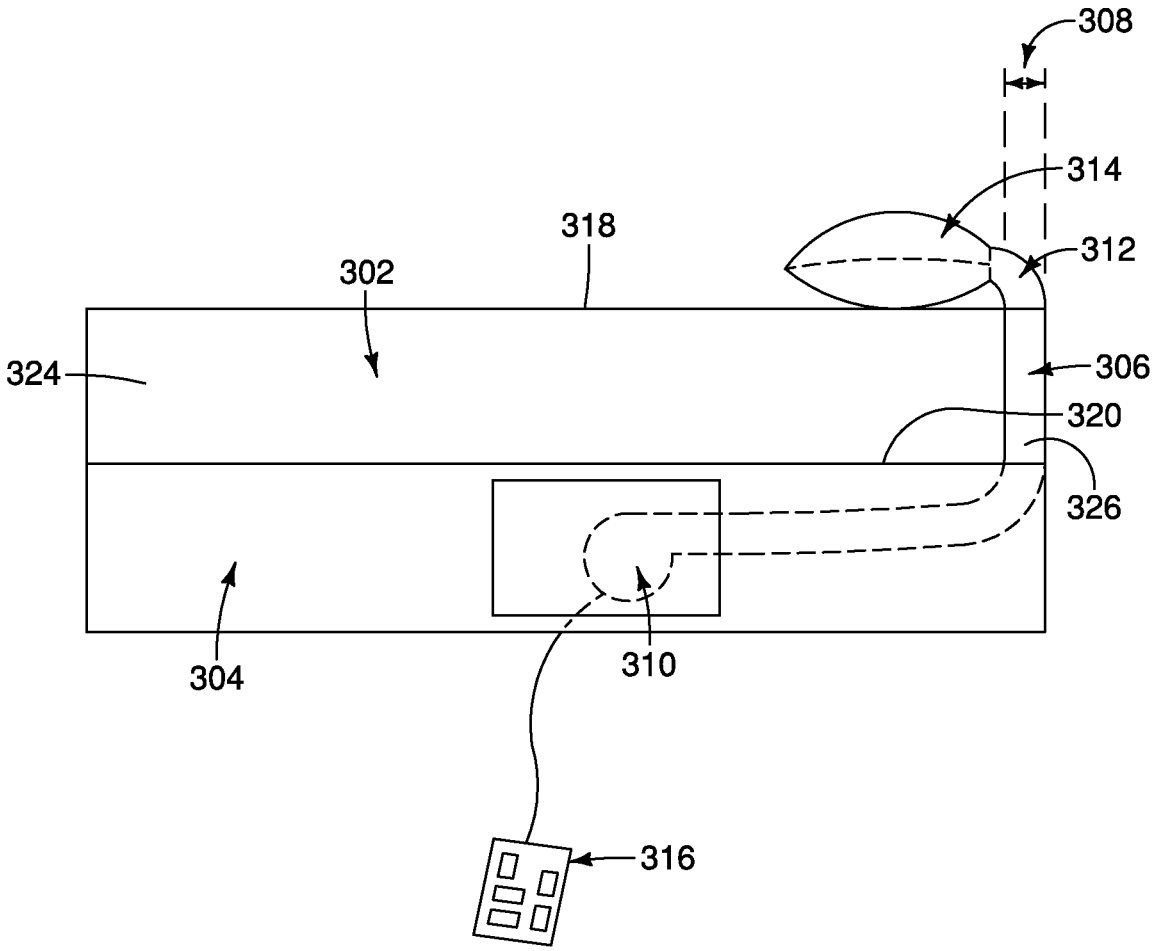
FIG. 3 is side view of a personal air filtration system according to embodiments of the invention.

An alternative embodiment is shown in FIG. 3. In this embodiment, the mattress 302 is undersized relative to the foundation 304 to allow the passage of the outflow ducting 306 from the blower 310 within the foundation 304 to the top surface 318 of the mattress 302 without the need for vertical channels within the mattress 302. Rather, the outflow ducting 306 can pass vertically to the top surface 318 of the mattress 302 by passing out of the foundation 304 through the top surface 320 of the foundation 304 and passing adjacent to but outside of the head end 322 of the mattress 302 within a ducting gap 326. In the embodiment shown, the outflow ducting 306 passes adjacent to the head end 322 of the mattress 302, with the length of the mattress 302 undersized relative to the length of the foundation 304. Alternatively, the outflow ducting 306 could pass around the side end 324 of the mattress 302, such as around a side end 324 of the mattress 302 but close to the head end 322 of the mattress 302. In such embodiments, the width of the mattress 302 would be undersized relative to the foundation 304 to form a ducting gap 326 above the foundation 304.

In embodiments in which the mattress 302 is undersized relative to the foundation 304, the difference in length 308 between the mattress 302 and foundation 304 is intended to be small, such as from 0.5 to 3.0 inches. The size difference 308 is the amount necessary to permit adequate cross sectional area for the outflow ducting 306 to communicate airflow from the blower 310 to the connection point 312 which is coupled to the air plenum of the head support 314. An optional remote control 316 for the blower 310 is shown.

Alternatively, the mattress 302 and the foundation 304 may be of the same size, but the mattress 302 may be offset slightly, relative to the foundation 304. In such embodiments, the outflow ducting 310 may pass through the upper surface 320 of the foundation 304, for example, and pass to the top surface 318 of the mattress 302 through the ducting gap 326 provided by the offset, such as at the head end of the bedding structure. Optionally, a filler may be used to fill the space where the mattress 302 overhangs the foundation 304, such as at the foot end of the bedding structure. In other embodiments, the mattress 302 and foundation 306 may be the same size, with the mattress 302 sitting directly atop the foundation, without any offset or overhang. The ducting may simply extend vertically to the top of the mattress 302 around the side of the mattress (and optionally the foundation) without a vertical channel.

Figure 4:
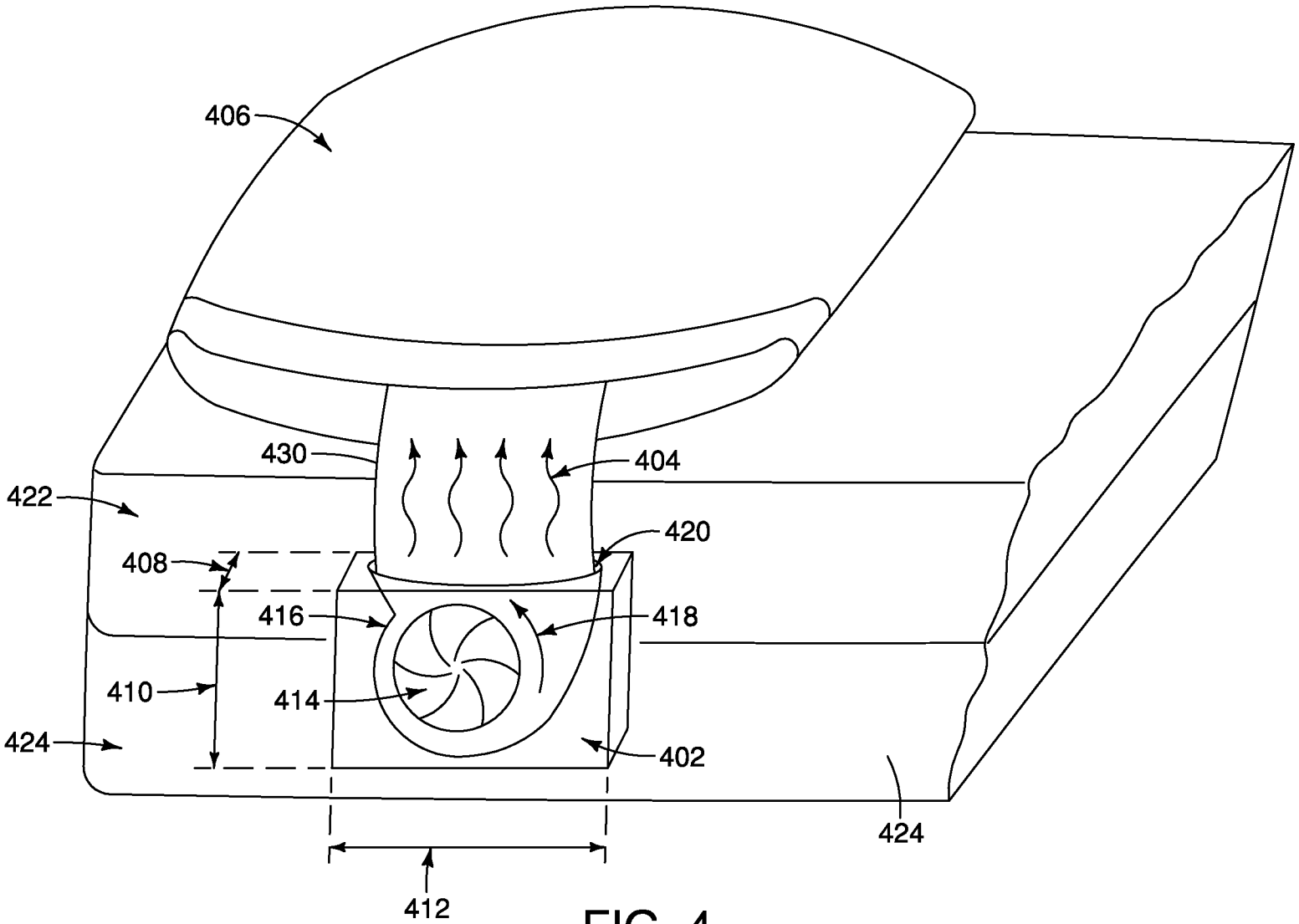
FIG. 4 is a rear perspective view of a personal air filtration system according to embodiments of the invention.

FIG. 4 depicts an alternative embodiment of a blower 402, and head support 406, including an air plenum that utilizes the same principles of operation as explained above to create a zone of filtered air that is either proximate a breathing zone of a user or surrounding a breathing zone of a user. In this embodiment, the blower 402 is located adjacent to the side of the bedding structure, without the use of a blower cavity. The blower 402 may be attached to or affixed to the side edge of the bedding structure, such as at the side or head of the mattress 422 and/or foundation 424. For example, the blower 402 may include one or more brackets or other attachment mechanisms. The attachment mechanism may attach the back of the blower 402 to a side edge of the mattress 422 and/or the foundation 424, or may slide between the mattress 422 and the foundation 424. As described previously, the blower 402 provides a pressurized air flow 404 to the head support and air plenum 406.

In some embodiments of the blower 402 may have a rectangular shape with approximate dimensions of 3 by 12 by 13 inches for depth 408, height 410, and width 412 respectively. The blower may utilize a reverse curve impeller 414 having, for example, an 8 inch diameter and running at more than one rotational speed, such as three rotational speeds 418 between 800 and 1700 revolutions per minute. Such embodiments can be used to deliver an airflow 404 ranging from 1 to 100 CFM, for example. The scroll 416 may be shaped having a logarithmic expansion profile and may connect to an oval shaped exit port 420 at the top of the case. The air plenum within the head support 406 connects to the blower 402 at attachment point 420, such as by means of a head support sleeve 430 or hose or plenum sleeve, such as by a draw string (not shown).

In the embodiment of FIG. 5 additional features of an air filtration device 500 are apparent. The blower 502 includes an air intake port 504 for drawing air into the system from the surrounding environment. It is preferably small to allow for easy transportation and concealment. Also, due to the location of the blower 502 within or beneath or abutting the side of the bed during use, blower 502 is relatively quiet. For example, in one embodiment, a blower produces a maximum noise level of approximately 60 decibels, which will be further reduced by the presence of the bedding structure to muffle the sound in some embodiments. The blower 502 should be adapted to provide air at a flow rate capable of sustaining a zone of filtered air of at least one liter about the breathing zone of a user. In some embodiments, such a flow rate can range from 1 cubic foot per minute to 100 cubic feet per minute.

The blower 502 can include one or more control knobs 506, buttons or other interface means for controlling blower speed or other optional features, in addition to or as an alternative to a remote control (not shown). For example, the blower 502 may optionally include a component which produces white noise to obscure any noise produced by the blower. Other optional features which may be included in the blower 502 include a temperature control to heat or cool the air, an air humidifier, a medication dispenser, and/or an aroma dispenser. These optional features may be controlled manually or automatically, such as by a timing mechanism. For example, a stimulating aroma such as mint or citrus may be emitted in the morning to function as an alternative to, or in addition to, an audible alarm. A soothing aroma such as lavender may be emitted while the user is going to sleep and could automatically stop after a preset amount of time. Moreover, in some embodiments, the blower 502 may include one or more filtration mechanisms (e.g. an ultraviolet radiation filter, a carbon-based filter, or a HEPA or other mechanical filter). An air intake filtration mechanism may be positioned proximate the air intake port 504 to filter air as it is drawn into the blower 502. Alternatively, a filtration mechanism may be placed near the air outlet to filter the air as it leaves the blower 502. Embodiments including a blower 502 having a filtration mechanism may or may not include an additional filter positioned downstream of the blower, such as those discussed elsewhere in this application.

The blower 502 can be coupled with the head support 508 by outflow ducting 510. The outflow ducting 510 can have a proximal section 512 which is attached to the blower 502, a distal section 514 which is attached to the head support 508, and a middle section 516 connecting the proximal and distal sections 512, 514. Alternatively, the head support 508 may include a tubular extension forming a head support sleeve, in flow communication with a plenum, which may directly attach to the blower 502. In other embodiments, an insertable plenum may include a plenum sleeve which may connect directly to the blower 502. In some embodiments, the outflow ducting 510 can include a detachable attachment mechanism 518 at one or both ends for detachably coupling the outflow ducting 510 to the blower 502, the head support 508, or both. Alternatively, the head support sleeve or plenum sleeve can include similar detachable attachment mechanisms for direct attachment to the blower 502. Examples of detachable attachment mechanisms 518 can include threaded cuffs, tapered joints, grooved joints, or other mechanisms known in the art. The shape of the blower and relative locations of the air intake port 504, control knobs 506, detachable attachment mechanism 518 and any other components will vary depending upon the choice of location of the blower 502. For example, when used in a foundation, the blower 502 may have a relatively thin, flat profile. The air intake port 504 may be oriented toward the head of the foundation to directly receive ambient air or to receive air through an inflow channel connecting the blower cavity to the ambient air. Alternatively, the air intake port 504 may be facing the bottom surface of the blower cavity, to face the floor, to access the ambient air through a hole or passage through the bottom surface of the blower cavity in the underside of the foundation to obtain ambient air from underneath the bed.

The outflow ducting 510 (or alternatively the head support sleeve or plenum sleeve) may be comprised of a rigid or semi-rigid material to prevent collapse. Alternatively, the outflow ducting 510 (or head support sleeve or plenum sleeve), or portions thereof, may be comprised of a collapsible material, such as fabric or polymeric foam. Such a collapsible ducting 510 (or sleeve) would inflate when air pressure is applied and would not feel like a hard object if the user places an arm or hand on the hose during the night. In some embodiments, the outflow ducting 510 is composed of both a rigid or semi-rigid material and a collapsible material in different regions. It may optionally include a formed elbow to transition the airflow from a substantially horizontal direction to a substantially vertical direction. In some embodiments, the outflow ducting 510 (or sleeve), or a portion thereof, is comprised of a flexible material such as an air impermeable fabric and includes pleats 222 over a portion or all of the ducting 510, such as to prevent the ducting 510 from collapsing when bent. In the embodiments shown, the distal section 514 of the ducting 510 can be seen to connect to the head support 508 at an air inlet 520. The ducting 510 may be permanently attached to the air inlet 520 or may be detachable from the head support 508 as described above. In some embodiments, a portion or all of the outflow ducting 510 (or sleeve) is comprised of a corrugated rigid or semi-rigid material such as plastic, to allow it to be flexible to shrink or expand in length to adjust for mattresses of varying thicknesses. In some embodiments, the outflow ducting 510 (or sleeve) has an oblong or rectangular shape, to give it a low profile. The inflow ducting (not shown), if present, may also be constructed as described in this paragraph.

Figure 6:
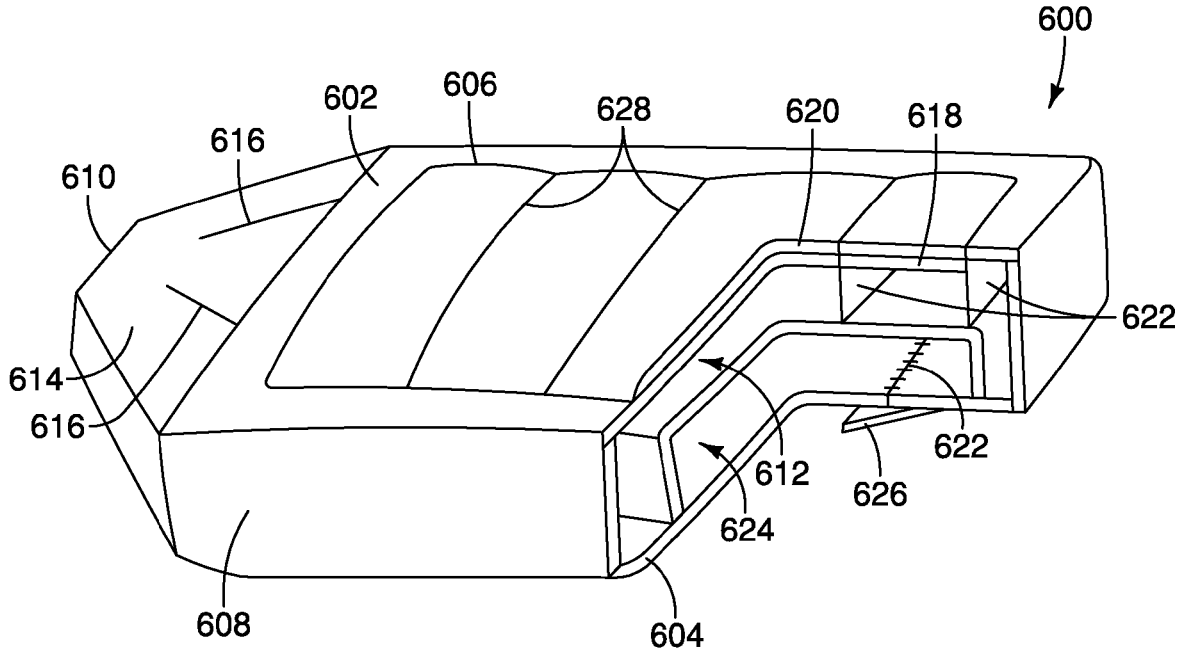
FIG. 6 is a partial cut away perspective view of a head support according to embodiments of the invention.

FIG. 6 shows a perspective view of an embodiment a head support 600 having a portion cut away to reveal internal features. The head support 600 can include an upper surface 602 to be positioned adjacent to the user's head, and a lower surface 604 to be positioned adjacent to a the bed. A portion 606 or all of the upper surface 602 is air permeable while the lower surface 604 is generally air impermeable. The upper and lower surfaces 602, 604 should be constructed of a soft, pliable material so that a user can comfortably lay his or her head atop the device. In some embodiments, the upper and lower surfaces can be coupled together along their respective edges at a seam or other air tight joint. Other embodiments, such as that of FIG. 6, can include a side panel 608 for joining the upper and lower surfaces 602, 604. A side panel 608 can be constructed of a generally air impermeable material, such as the material used to construct the lower surface 604. In a preferred embodiment, the air impermeable surfaces of the head support 600 are constructed of micro fiber Polyester or coated Nylon Supplex coated both of which are available from Dupont. The upper and lower surfaces 602, 604 can be connected to the side panel 608 by any means suitable for creating a generally air tight connection, such as sewing, adhesive, or thermal bonding.

Head support 600 also includes an air inlet 610. The air inlet 610 can be a hole through a side panel 608 or, in embodiments not including a side panel, a gap in the connection between the upper and lower surfaces 602, 604. The air inlet 610 provides a direct or indirect flow connection between the head support 600 and the blower (not shown). In some embodiments, the air inlet 610 can include a detachable joint mechanism for detachably coupling a hose or ducting to the head support 600. Alternatively, the head support inlet 610 may be located in an air impermeable head support sleeve extending from the head support and attaching directly to a blower outlet. In the embodiment shown, the air inlet 610 is located on the side edge of the head support 600, such as for use with a ducting (or a head support sleeve or plenum sleeve) extending around the side end of a bed. Alternatively, the air inlet 610 may be located on the top edge of the head support 600, for use with a hose, ducting, head support sleeve or plenum sleeve that extends around the head side or head end of a mattress.

In some embodiments, the surfaces of the head support 600 bound a plenum 412 to be filled with air supplied by the blower. The plenum 612 provides a chamber within the head support 600 where air can gather and disperse prior to the air escaping through the permeable portion 606 of the upper surface 602 and into the space surrounding the head of the user. In this way the plenum 612 allows air to be delivered generally uniformly across the entire surface area of the air permeable portion of the upper surface. In other embodiments, the head support includes a plenum pocket into which a plenum may be inserted, such as the plenum shown in FIG. 9.

To further assist the uniform distribution of air flow from the plenum 612, some embodiments include an inlet manifold 614. An inlet manifold 614 can be a fan-shaped portion of the head support 600 or a separate component disposed between the plenum 612 and the air inlet 610. In some embodiments, the inlet manifold 614 can include internal air guides 616 to assist in evenly distributing air flow from the air inlet 610 to the plenum 612. Internal air guides 616 can be panels disposed within the manifold 614 so as to cause air to diverge upon entering head support 600 through the air inlet 610. A secondary purpose of the internal air guides 616 is to maintain the manifold in a flattened shape and prevent the surfaces from bulging upward under pressure. An inlet manifold 614 can be constructed of an air impermeable material such as the material used to construct the lower surface 604 of the head support 600.

A personal air filtration device according to the invention includes a filter 618 to filter the air flow that is to be delivered at the air permeable portion 606 of the head support 600. In some preferred embodiments, the filter 618 is disposed downstream from the blower. The filter 618 may be comprised of a material which provides HEPA (high efficiency particulate air) levels of filtration, such as Technostat® (available from Hollingsworth & Vose Company of East Walpole, Mass.). In some embodiments, a layer of activated charcoal may be added, possibly adjacent to the filter, for providing odor reduction.

Many arrangements can be used to position a filter downstream from a blower, for example, a filter can be placed at the air inlet 610 of head support 600, within an air inlet manifold 614, within a plenum sleeve, or within a hose or ducting. Each of these arrangements and others are contemplated and should be considered within the scope of the present invention. In some preferred embodiments, the filter can be a point of delivery filter. Such a filter can be seen in the embodiment of FIG. 6, for example. In this arrangement, a filter 618 is disposed about and coextensive with the air permeable portion 606 of the head support 600, i.e. at the point of delivery of the air flow to the breathing zone. In such embodiments, the filter 618 is generally coextensive with the air permeable portion 606 of the head support 600, such that the air can be filtered through a relatively large surface area. As a result, the pressure drop induced as the air traverses the filter 618 is much less than that caused by traversing a smaller surface area of the same filter material. Because of the reduction in pressure and air flow, the blower can perform more quietly while still producing an adequate volume of filtered air. By locating the filter 618 on the upper surface 602 of the head support 600, a point of delivery filter causes the air flow to be filtered immediately prior to it entering the breathing zone. Therefore, the air is less likely to be contaminated post-filtration by environmental factors that may be present.

As shown, the edges of the point of delivery filter 618 form a permanent and air tight connection with the air impermeable portion of the upper surface 602 of the head support 600. In such embodiments, the entire head support may be periodically washed or disposed of and replaced as needed. Alternatively, the filter may be removably attached to the air impermeable portion by filter attachment elements such as adhesive, hook and loop fasteners (e.g. Velcro), zippers, and/or other forms of attachment. A removable filter can be removed for cleaning of the filter or head support, or may be replaced periodically without requiring replacement of the entire head support.

In some embodiments, the filter material may be somewhat friable such that small fibers may break off of the filter surface, such as when contacted by a user's face during sleep. In addition, the user may find the feeling of the filter against his or her face to be unfamiliar. To prevent these problems, the upper surface 602 may include a filter cover 620. The filter cover 620 can be made of a material which is air permeable to allow filtered air to pass through from the filter 618 to the user's breathing zone. As an example, in one embodiment, a filter cover made of 620 thread-count Teflon coated cotton or satin can be used. Such a filter cover 620 may feel more comfortable or more familiar to the user. It may also act as a barrier between the filter and the user's face so that fragments of the filter do not come into contact with the user. Further, in some embodiments, a filter cover may include a hydrophobic composition or treatment. Such a composition can be applied to or included in the filter cover to provide stain- or water-resistant properties.

In some embodiments, filter cover 620 can attach to the head support 600 at the edges of the filter 618 or it may be larger than the filter 618 and attach beyond of the edges of the filter 618. Only a portion of an edge of the filter cover 620 may attach to the head support 600, or the entirety of all edges of the filter cover 620 may attach to the head support 600. When the entire edge of the filter cover is attached to the head support 600, it can enclose the filter 618 such that any fibers that detach from the filter 618 are encased within the space between the filter 618 and the filter cover 620, so that they do not come into contact with the user. Alternatively, a filter cover may be removably attached to the head support 600 such as by hook and loop attachment or zippers. Removable attachment along a portion or all of the edges of the filter cover 620 may be desirable in embodiments in which the filter is removable for washing or replacement, to allow access to the filter. In alternate embodiments, the filter cover 620 may be attached to the filter, which, in turn, attaches to the head support 600.

As an alternative or in addition to a filter cover 620, embodiments may include a pillow case for surrounding the head support 600 and making it more comfortable for a user. A pillow case can be similar to a standard pillow case but should be sized to fit around the inflated head support 600. When installed, the pillow case lies between the upper surface 602 and the user's head and between the lower surface 604 of the head support 600 and the bed. A suitable pillow case should be made of an air permeable material so as to allow the filtered air from the personal filtration device to pass through to the user's breathing zone.

Figure 7:
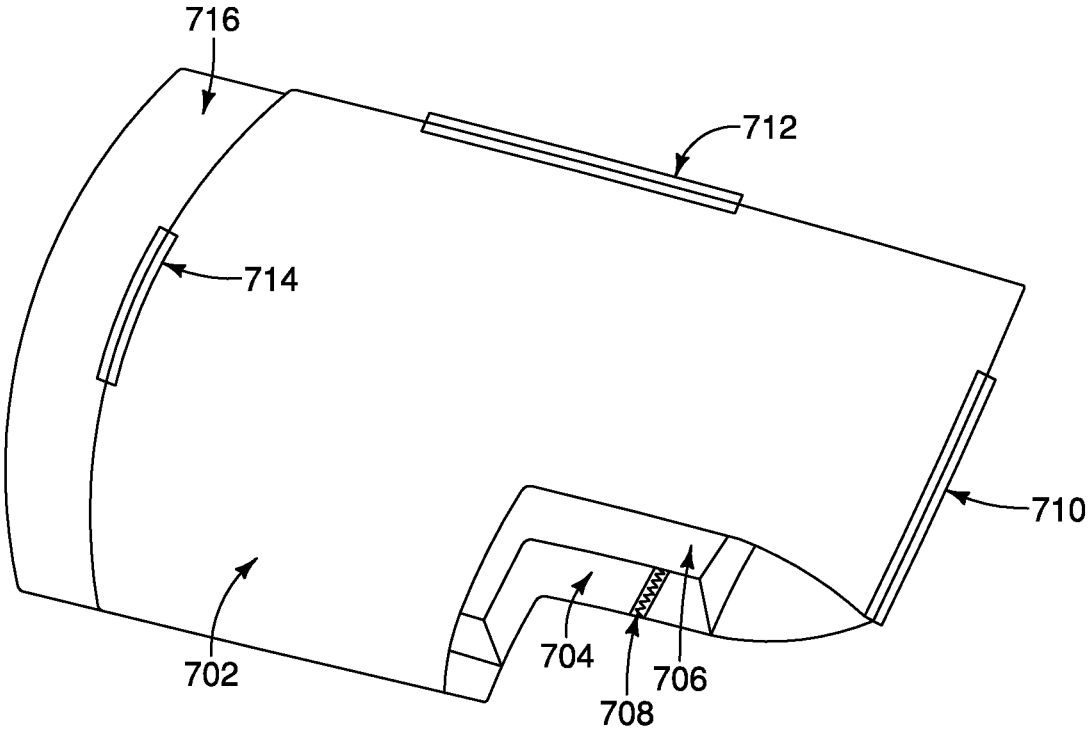
FIG. 7 is a perspective view of a head support, partially cut away, of a personal air filtration device according to embodiments of the invention.

Another embodiment of a head support is shown in FIG. 7. The head support 702 is shown in a cut-away manner and is a case which includes a pillow pocket 704 and air plenum pocket 706. The head support 702 may be made of pure cotton or a blended cotton polyester fabric, for example. The pillow (not shown) can be inserted into the pillow pocket 704 through an opening 708 in the bottom surface of the pillow pocket 704, such as a French fold fabric overlap. An air plenum (not shown) can be inserted into the air plenum pocket 706 through an opening 710, 712 in the plenum pocket 706 which may be sealed by means of a zipper or other equivalent closure mechanism. The upper surface of the plenum pocket 706 includes an air permeable portion, while the lower surface includes an air impermeable portion. In this way, air that exits the inflatable plenum passes through the upper surface of the plenum pocket, which comprises the upper surface of the head support, to be provided to the user's breathing zone.

The head support 702 may include one or more, such as two or three, optional openings into the plenum pocket. FIG. 7 depicts optional locations for the openings 710, 712, 714, including near of on the side edge (oriented toward the side of the bed) or on the head edge (oriented toward the head end of the bed) of the head support, for example. The head support may optionally include a decorative band 716, such as extending along and/or around one side edge, to give it the look of a traditional pillow case. For example, the decorative band may be composed of the same material as the upper surface of the head support 702, or a different material, and may be defined by a seam 718 separating the decorative band from the rest of the head support. The seam may be an ordinary seam, or may include a decorative band or material. In some embodiments, an air plenum sleeve may extend through one of the openings 710, 712, 714 to connect to a blower.

In some embodiments, the plenum pocket 706 functions as a plenum, without the need to insert a separate plenum. In such embodiments, the plenum pocket itself is filled with pressurized air to form a plenum.

Figure 8:
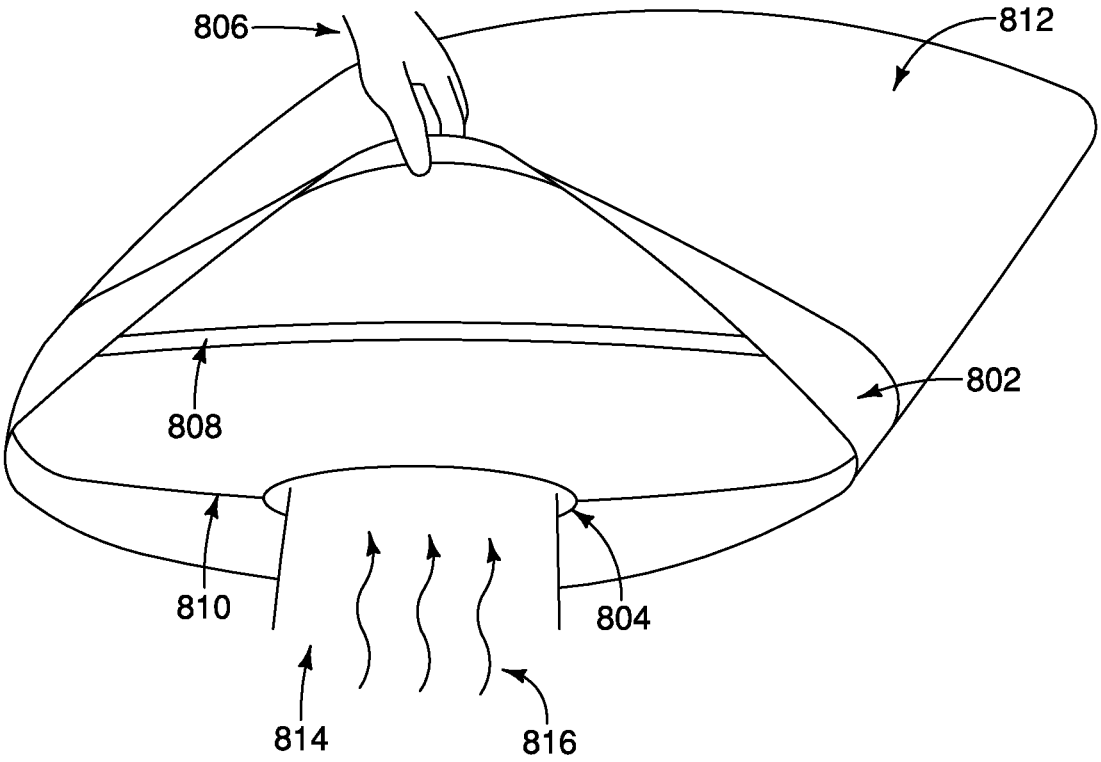
FIG. 8 shows a decorative band and a zippered opening from a side perspective view of a head support.

FIG. 8 shows a side view of the head support like that of FIG. 7. The optional decorative band 802 is being lifted to reveal the construction features of the decorative band seam 808 and pillow pocket seam 810. An air plenum sleeve 814 is shown extending from the zippered opening 804 and receiving an airflow 816 from a blower (not shown).

Figure 9:
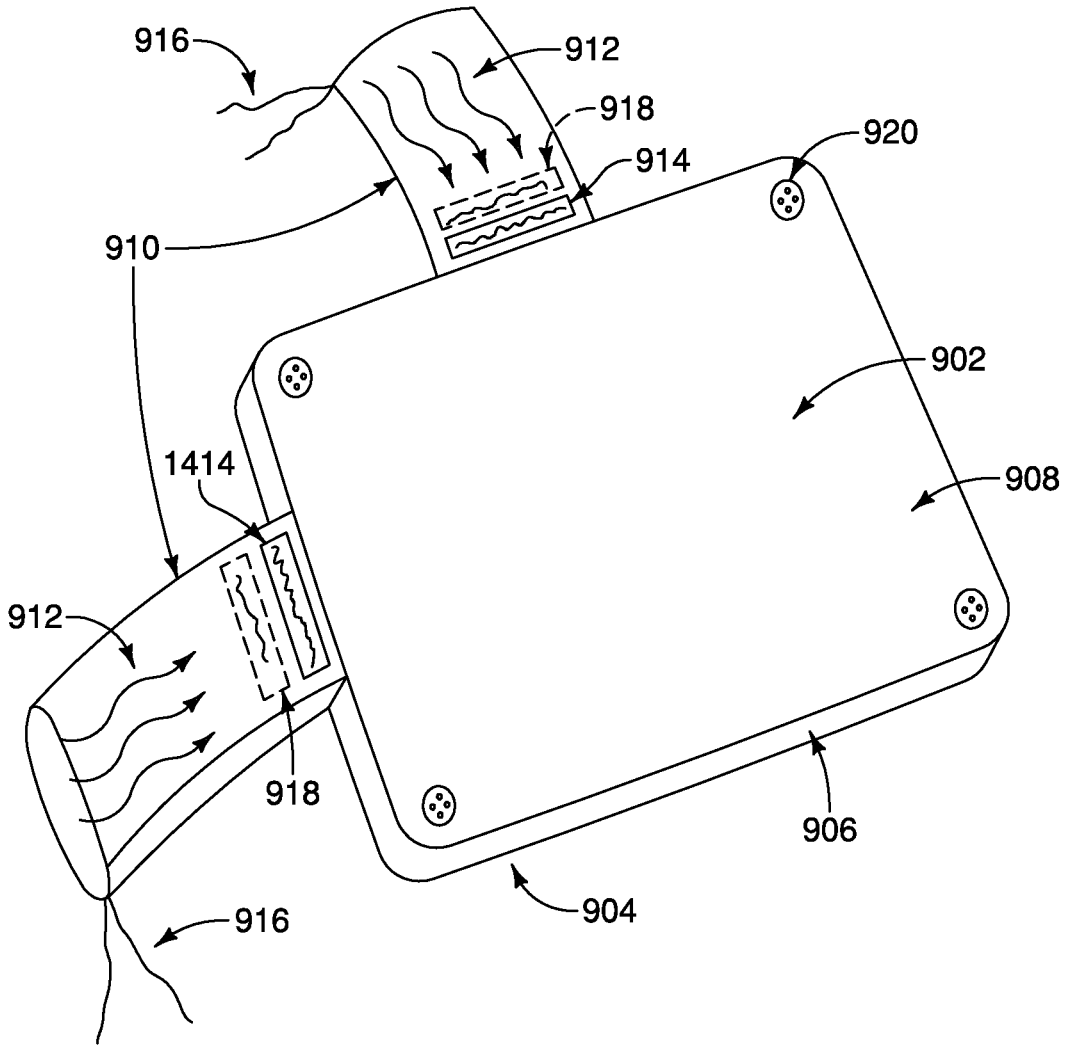
FIG. 9 shows an air plenum of a personal air filtration device according to embodiments of the invention.

FIG. 9 shows the embodiment of an insertable air plenum 902 which may be used in head supports having a plenum pocket, for example. The air plenum 902 is constructed as a sealed bag and has at least a portion or all of the plenum which is air permeable. For example, the plenum 902 may have an air impermeable bottom 904 and sides 906 made of coated nylon (or equivalent fabric) and an air permeable top surface 908. The top surface 908 may be constructed of a filter material such as those described above. The seams between the bottom 904, sides 906, and top surface 908 are shown as sewn, but any other equivalent means of connection such as heat sealing, adhesive, or other could be employed.

The air plenum 902 may include one or more fabric sleeves 912 extending from the side of the plenum 902 to extend outside of the plenum pocket for alternative attachment directly to outflow ducting or a hose for attachment to the ducting or hose through a user connection point. The hose or ducting then extend around the head of the bed or the side of the bed to connect the plenum 902 to a blower. Alternatively, the plenum sleeve may attach directly to the blower. In some embodiments, the fabric sleeve 912 is attached to the user connection point or a blower by securing the drawstring 916 around the connection protrusion (not shown). The plenum 902 is then pressurized by receiving an airflow 912 that inflates the air plenum 902. When the fabric sleeve 910 not connected to a blower can be sealed off by closing the opening. For example, it may be closed by pushing the sleeve 910 into the internal cavity of the air plenum 902 and securing the top surface 914 and bottom surface 918 (shown as dashed) together to form a substantially air tight seal such as through a band of hook and loop material. Optional attachment buttons 920 are shown around the periphery of the top surface 908 that can be used to secure the air plenum 902 to the head support (not shown). Alternatively, the plenum 902 may be secured by hook and loop material, snaps, or other forms of attachment.

Figure 10:
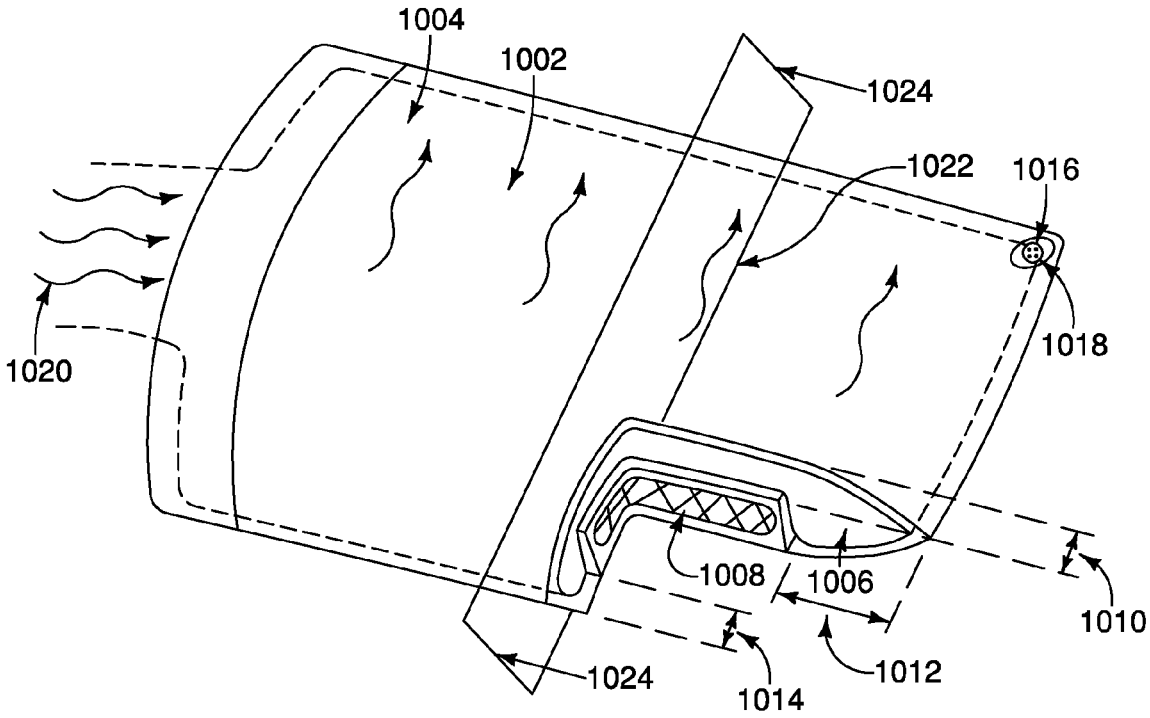
FIG. 10 shows a perspective view of a head support and an air plenum assembly, partially cut away, according to embodiments of the invention.

An assembly of the head support 1002 and insertable air plenum 1004 (shown as dashed lines) described in FIGS. 7 and 9 is shown as FIG. 10. As seen, the air plenum 1004 inflates to occupy the air plenum pocket 1006 of the head support 1002. In some embodiments, when the air plenum 1004 is inflated, the dimensions of the air plenum pocket 1006 extend past the pillow pocket 1008 (shown hatched), such as up to a maximum of 8 inches, 4 inches, and 3 inches for depth 1010, width 1012, and length 1014 respectively. The plenum may be secured within the plenum, such as by fastening the plenum to the bottom of the plenum pocket. In the embodiment shown, a fabric loop 1016 is provided in each of the four corners of the plenum 1004 for attachment to air plenum attachment buttons 1018 on the bottom surface of the plenum pocket 1006 to prevent excessive movement of the air plenum 1004 within the air plenum pocket 1006. Alternative forms of attachment could be used, including hook and loop attachment, snaps, or zippers, for example.

Under operation, an airflow 1020 provided by a blower (not shown) inflates the air plenum 1004 (either as an insertable air plenum 1004 or as the plenum pocket 1006 itself forming a plenum). The air may be filtered by a point of delivery filter substantially co-extensive with the top surface of the air plenum 1004 or a filter located upstream, such as within a head support sleeve, plenum sleeve or outflow ducting. The filtered air 1022 flows through the top surface of the air plenum 1004, through the top surface of the head support 1002 (or directly through the top surface of the head support when no insertable plenum is used), and to the user.

Figure 11:
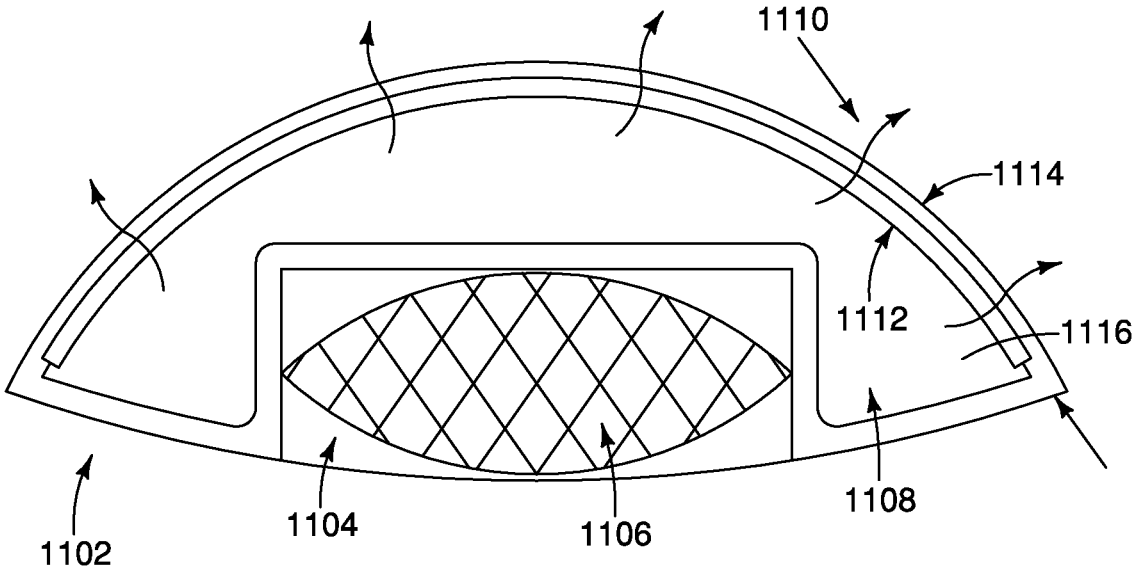
FIG. 11 shows a cross-sectional view of the head support and air plenum assembly of FIG. 10.

FIG. 11 shows the cross section plane 1024 of FIG. 10 to illustrate the internal air flow mechanics of the head support 1002 and air plenum 1004 under operation. The head support 1102 of FIG. 11 includes a pillow pocket 1104 which includes a pillow 1106, the structure of which substantially defines the physical shape of the head support pillow pocket 1104. The insertable air plenum 1116 is inflated to occupy the plenum pocket 1108. Alternatively, the plenum pocket 1108 may itself be inflated to form a plenum. Pressurized air, provided by a blower (not shown), produces an airflow 1110 that diffuses through the air permeable portion 1112 of the plenum 1116 and optional protective covering (not shown). In some embodiments, the air permeable portion 1112 is a filter. The airflow 1110 then passes through the air permeable top surface 1114 of the plenum pocket 1108. Alternatively, the pressurized air may flow directly through the top surface 1114 of the plenum pocket 1108 when no insertable plenum 1106 is used. In some embodiments, the air permeability of the top surface 1114 of the head support 1102 is in the range of 0.3 to 1.5 cubic feet per minute at a pressure of 0.25 inches of water.

Figure 12:
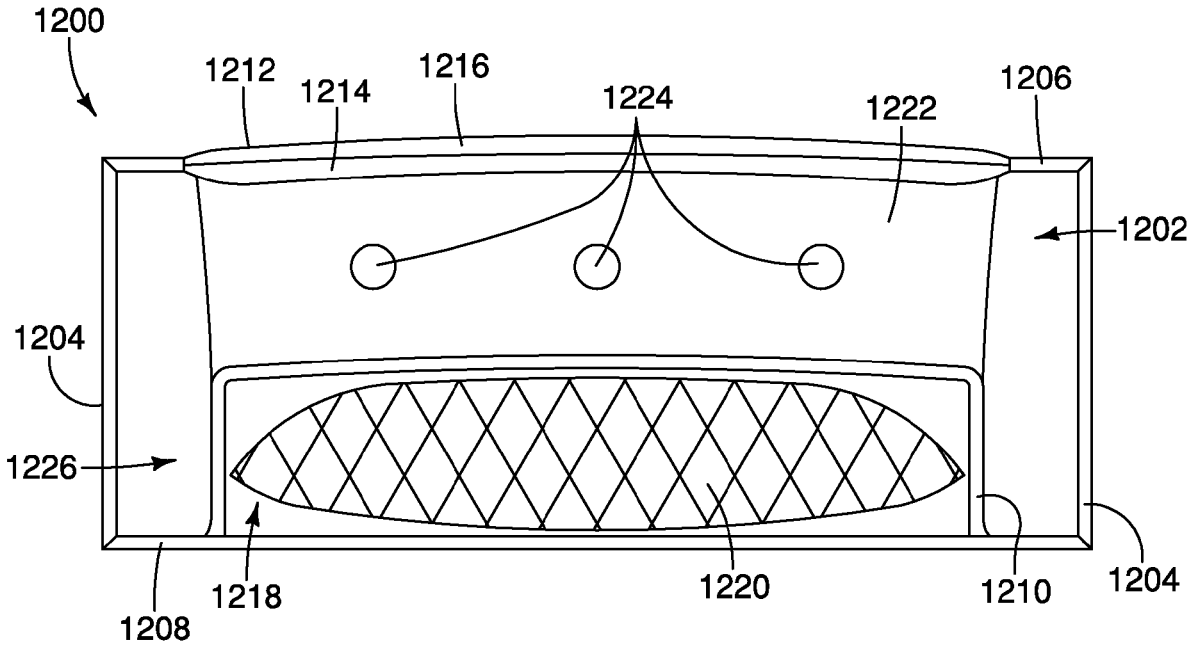
FIG. 12 is a cross-sectional view of a head support according to embodiments of the invention.

FIG. 12 is a cross-sectional view of an alternative embodiment of a head support 1200. From this view several internal features of a head support 1200 are apparent. In this embodiment, the interior of the head support 1200 includes a plenum 1202 defined by side panels 1204, top surface 1206, bottom surface 1208, and a pillow chamber wall 1210. In operation, air flow accumulates within the plenum 1202 and is passed through the air permeable portion 1212 of the top surface 1206. The air permeable portion 1212 can include both a point of delivery filter 1214 and a filter cover 1216. A pillow chamber 1218 including a pillow 1220 is also disposed within the interior of the head support 1200. In this embodiment, the pillow chamber is defined by pillow chamber wall 1210 and the bottom surface 1208 of the head support 1200. The pillow chamber wall 1210 may be constructed of the same air impermeable material as the bottom surface 1208. The pillow chamber 1218 can be sized so as to accommodate insertion of a standard or otherwise sized pillow. In some embodiments, a pillow 1220 can be sewn or sealed into a pillow chamber 1218. Alternatively, embodiments such as that of FIG. 6 can include an opening 622, such as a zipper or hook and loop material or other access means, for allowing a pillow to be inserted or removed from the pillow chamber 624. In such embodiments, an air impermeable flap 626 may be secured externally to cover the opening 622 to prevent air from leaking through. Some embodiments do not include a pillow chamber, but include some other pillow connection means such as, for example, connectable straps running under the head support. Embodiments which include a pillow chamber having an access means or other pillow connection means can allow the user to select a preferred pillow to be used with the personal air filtration device.

In some embodiments, the plenum 1202 can include support structures to facilitate proper air flow within and out of the head support 1200. For example, the embodiment shown in FIG. 12 include baffles 1222 (also shown as 622 in FIG. 6) spanning the plenum 1202 between the pillow chamber wall 1210 and the top surface 1206 of the head support 1200. A baffle 1222 can be used to restrict the expansion of the top surface 1206 as the plenum 1202 fills with air. Such restriction can be necessary to prevent doming of the air permeable portion 1212 which can distort the direction in which air is released from the plenum 1202 resulting in less effective delivery of air to the breathing zone. In some embodiments, baffles 1222 can include internal air passages 1224 to facilitate air flow throughout the plenum 1202. Baffles 1222 should be constructed of a soft, pliable material so as not to cause discomfort to a user resting upon the head support. For example, the baffles 1222 could be constructed of the same material as the bottom surface 1208 of the head support 1200. Baffles 1222 can be attached to the head support 1200 by any suitable means, such as for example sewing, adhesive, or thermal bonding. Some baffle attachment means, such as stitching, may penetrate the surface to which the baffle is attached, resulting in air leakage points in the plenum 1202. To prevent unfiltered air from escaping through these leakage points, some embodiments include an air impermeable seal along the baffle joint (e.g. over stitch 628 in FIG. 6).

The cross-section view of FIG. 12 further reveals that the pillow chamber 1218 can be sized so that it is smaller than the head support 1200. By this arrangement, a perimeter channel 1226 can be defined by the side panel 1204, the bottom surface 1208, and the pillow chamber wall 1210. A perimeter channel 1226 can be advantageous in providing an even distribution of air throughout the plenum 1202 when a user is resting upon the head support 1200.

Further, some embodiments may include rigid or semi-rigid support structures within the plenum to maintain air flow across the plenum. Rigid or semi-rigid support structures can provide sufficient open space to allow air to flow through or around the structures. Such structures should be strong enough to prevent at least a portion of the plenum from completely collapsing against the pillow under the weight of a user's head while remaining flexible or soft enough so as not to disturb the user.

As discussed above, the head support may be adapted to be used with a pillow. Some embodiments may be adapted to contain a pillow (e.g. that of FIG. 6) while other embodiments can be adapted to lie on top of a pillow. In such embodiments, the head support may maintain this position in a variety of ways. For example, the head support may be attached to the pillow by including pillow attachment elements on the lower surface of the head support. Pillow attachment elements may be releasable, such as hook and loop fasteners, releasable adhesive, zippers, snaps or buttons. Other forms of pillow attachment elements which may be used include pouches and ties. Releasable forms of pillow attachment elements may allow the user the flexibility of using the personal air filtration device while continuing to sleep on a preferred pillow. In some embodiments, a pillow case may be used to hold the head support in position on top of a pillow. For example, the head support and a pillow could be placed together inside a single pillow case large enough to accommodate the pillow and the inflated head support. The pillow case may be used instead of, or in addition to, pillow attachment elements. When a pillow case is used, it should be comprised of an air permeable material in at least the portion overlying the air permeable portion to allow the release of the filtered air around the user's head.

Figure 13:
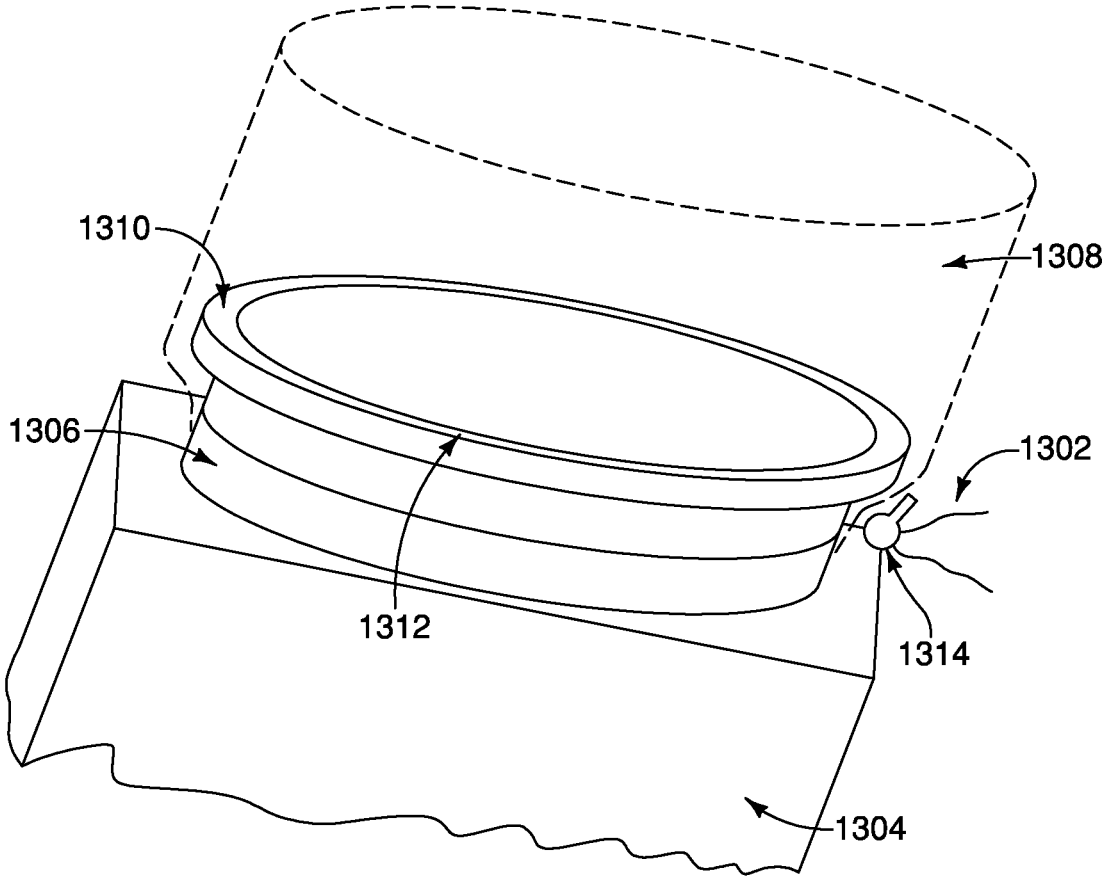
FIG. 13 is a perspective view of a drawstring, blower and attachment point, partially cut away, according to embodiments of the invention.

An example of the attachment of ducting 1308, or a head support sleeve or plenum sleeve, to a blower 1304 is shown in FIG. 13. The ducting 1308 (shown as dashed and see through) or head support sleeve or plenum sleeve slides over the projection or adapter 1310 and is secured in place by tightening a drawstring 1302 at the end of the hose to create interference between the draw string 1302 and a radially extending rim 1312 on or near the distal end of the projection adapter, distal to the draw sting 1302. The proximal end of the adapter 1310 engages the output of the blower 1304. The interference in the drawstring 1302 may be maintained by means of a ball lock 1314, or any conventional means such as a knot, buckle, ratchet, or equivalent, to maintain the tension in the drawstring 1302.

Figure 14:
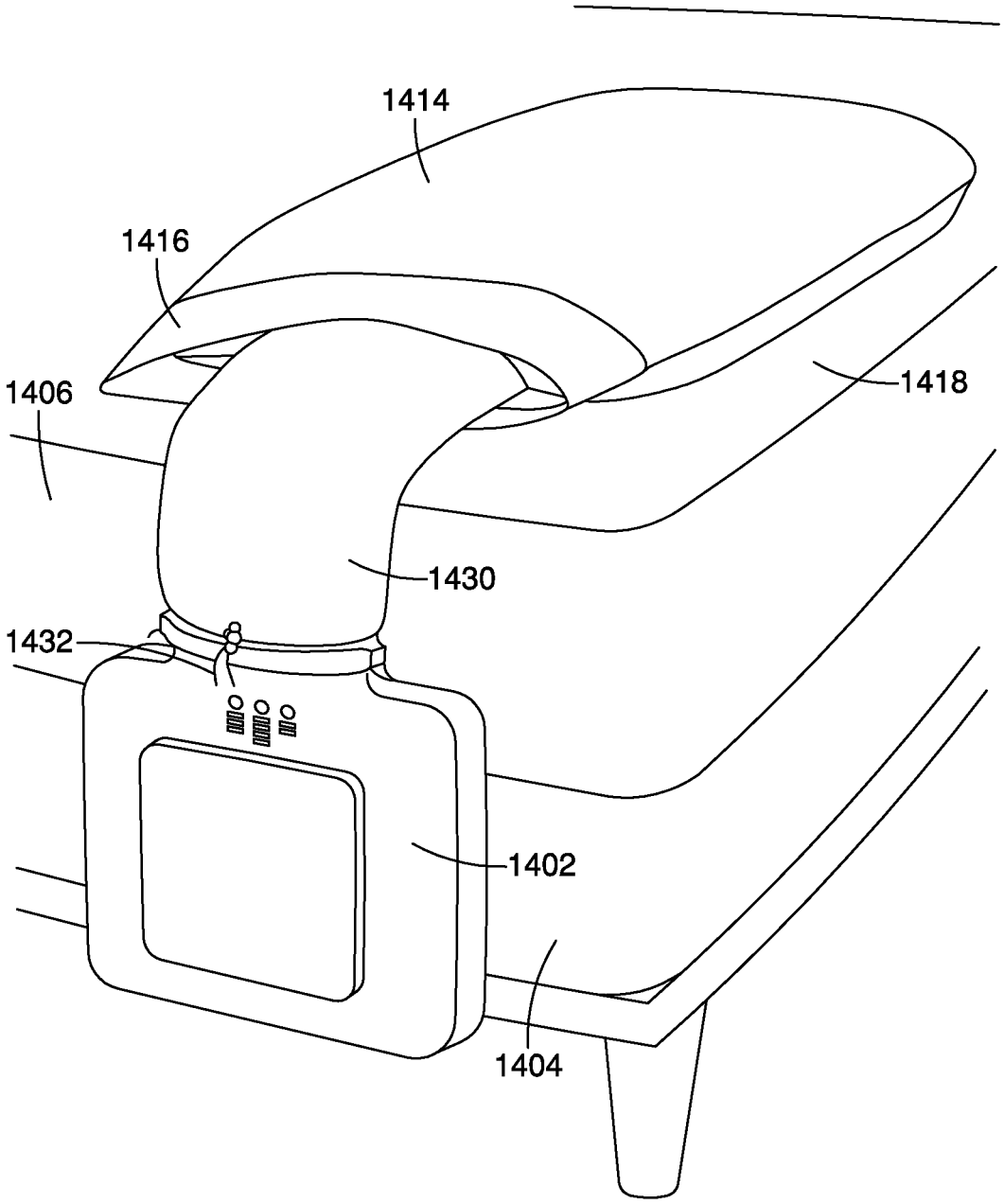
FIG. 14 is a perspective view of a personal air filtration device according to embodiments of the invention.

FIG. 14 shows an embodiment of an air filtration system, with the blower 1404 affixed to and abutting the side of the bedding structure. The blower 1402 is adjacent to the side of the foundation 1404, near the head end of the foundation 1404. A head support 1414 including a decorative band 1416 is located on the top surface 1418 of the mattress 1406. A tubular head support sleeve 1430 having a low profile extends from the head support 1414 from beneath/within the decorative band and around the side of the mattress 1406 to detachably connect directly with the blower 1402 at that blower projection 1410 using a drawstring 1432. The tubular head support sleeve 1430 may be an integral part of the head support 1414 and may be constructed of an air impermeable material to receive air flow from the blower 1402. In a preferred embodiment, air filtration is performed by a filter within the blower 1402 or within the tubular head support sleeve 1430. The head support sleeve 1414 serves as its own air distribution plenum and required no plenum insert, such as the plenum insert 902 shown in FIG. 9.

In the foregoing detailed description, the invention has been described with reference to specific embodiments. However, it may be appreciated that various modifications and changes can be made without departing from the scope of the invention as set forth. Although embodiments of the invention are described in the context of a hospital operating room, it is contemplated that some embodiments of the invention may be used in other environments. Those embodiments of the present invention, which are not intended for use in an operating environment and need not meet stringent FDA requirements for repeated used in an operating environment, need not including particular features described herein, for example, related to precise temperature control. Thus, some of the features of preferred embodiments described herein are not necessarily included in preferred embodiments of the invention which are intended for alternative uses.

The invention claimed is:

1. A system for creating a zone of filtered air proximate a head of a user, the system comprising an air filtration device, the air filtration device comprising:

a blower configured to provide an air flow, the blower being configured to be disposed within, below, or affixed to a bedding structure;

an inflatable air plenum being in flow communication with the blower, the inflatable air plenum configured to be inflated by air from the blower accumulating within the plenum and configured to support of the head of the user resting upon the inflatable air plenum, the inflatable air plenum having an air delivery surface configured to distribute the air flow from the plenum as filtered air to the zone of filtered air; and a filter disposed within the device for filtering the air flow before it is distributed to the zone of filtered air.

2. The system of claim 1, wherein the system further comprises a bedding structure.

3. The system of claim 2 wherein the bedding structure comprises a mattress and a foundation.

4. The system of claim 2 wherein the bedding structure comprises a blower cavity, wherein the blower is located within the blower cavity.

5. The system of claim 2 wherein the air filtration device further comprises air ducting providing flow communication between the blower and the air plenum, the air ducting passing through or around the bedding structure.

6. The system of claim 5 wherein the bedding structure further comprises one or more channels.

7. The system of claim 6 wherein the ducting is located within the one or more channels.

8. The system of claim 7 wherein the channels and the ducting are Y-shaped to provide air to two users.

9. The system of claim 5 comprising two air plenums, wherein the system further comprises two user attachment point for connecting the ducting to each of the plenums, and wherein airflow through either of the user attachment points may be blocked by the user.

10. The system of claim 1 wherein the air plenum includes a sleeve and wherein the sleeve is detachably attached to the blower.

11. The system of claim 10 wherein the filter is located within the sleeve.

12. The system of claim 1 wherein the blower includes brackets for mounting the blower in the side of the bedding structure.

13. A system for creating a zone of filtered air proximate a head of a user, the system comprising an air filtration device comprising, the air filtration device comprising:

a blower configured to provide an air flow, the blower configured to be disposed within, beneath, or affixed to a bedding structure;

a head support including an inflatable air plenum and a sleeve, the sleeve being attachable to the blower and the inflatable air plenum being in flow communication with the blower through the sleeve and configured to be inflated by air accumulating within the plenum and configured to support of the head of the user resting upon the inflatable air filled plenum, the inflatable air plenum having an air delivery surface configured to distribute the air flow from the inflatable air filled plenum as filtered air to the zone of filtered air; and a filter disposed within the air filtration device for filtering the air flow before it is distributed to the zone of filtered air.

14. The system of claim 13 wherein the head support includes an upper surface which forms an upper surface of the plenum.

15. The system of claim 14 wherein the head support further comprises a pillow pocket beneath the plenum.

16. The system of claim 13 wherein the head support comprises a plenum pocket into which the plenum is inserted.

17. The system of claim 13 wherein the filter is located within the sleeve.

18. The system of claim 13 further comprising a bedding structure comprising a mattress and a foundation, wherein the bedding structure comprises a blower cavity and one or more channels in the bedding structure.

19. A method of creating a zone of filtered air proximate a head of a user, the method comprising:

providing a bedding structure comprising a mattress;

providing an air filtration device comprising:

a blower configured to provide an air flow, the blower being disposed within, beneath or affixed to a side of the bedding structure;

an inflatable air plenum being in flow communication with the blower and in support of the head of the user, the inflatable air plenum having an air delivery surface configured to distribute the air flow as filtered air to the zone of filtered air, the inflatable air plenum being located at a head end of the bedding structure; and a filter disposed within the air filtration device for filtering the air flow before it is distributed to the zone of filtered air;

activating the blower to inflate the inflatable air plenum and to deliver filtered air from the plenum to the user.

20. The method of claim 19 wherein the plenum is connected to the blower by a sleeve and the filter is provided within the sleeve.

* * * * *